US005197801A

United States Patent [19]

Swisher

[11] Patent Number: 5,197,801

[45] Date of Patent: Mar. 30, 1993

[54] TUMBLER

[76] Inventor: Max B. Swisher, Box 67, Warrensburg, Mo. 64093

[21] Appl. No.: 744,494

[22] Filed: Aug. 13, 1991

[51] Int. Cl.[5] ..... B01F 9/02

[52] U.S. Cl. ..... 366/167; 366/220; 366/236; 422/209

[58] Field of Search ..... 366/167, 173, 182, 219, 366/220, 150, 236, 64; 422/209, 270, 269, 261, 278, 292; 136/291; 221/163

[56] References Cited

U.S. PATENT DOCUMENTS

| | | | |
|---|---|---|---|
| 715,665 | 12/1902 | Jewell | 366/120 |
| 3,054,663 | 9/1962 | Komline | 23/259.1 |
| 3,837,810 | 9/1974 | Richards et al. | 366/236 |
| 3,920,224 | 11/1975 | Fassauer | 366/195 |
| 4,042,219 | 8/1977 | Terry | 366/142 |
| 4,423,944 | 1/1984 | Waters, Jr. | 366/247 |
| 4,444,509 | 4/1984 | Steiner et al. | 366/157 |
| 4,448,232 | 5/1984 | McQueen et al. | 136/291 |
| 4,516,647 | 5/1985 | Novak | 136/291 |
| 4,633,535 | 1/1987 | Louvo | 4/449 |
| 4,781,119 | 11/1988 | Davis | 136/291 |
| 4,786,851 | 11/1988 | Fuji et al. | 320/2 |
| 4,808,904 | 2/1989 | Ricaud et al. | 320/2 |
| 4,942,723 | 7/1990 | Wassell | 136/291 |
| 4,946,108 | 8/1990 | Konig et al. | 248/71 |
| 4,987,729 | 1/1991 | Paytas | 136/291 |
| 5,109,989 | 5/1992 | Kremmin et al. | 211/163 |

FOREIGN PATENT DOCUMENTS

| | | | |
|---|---|---|---|
| 0522019 | 10/1955 | France | 306/236 |
| 0526473 | 9/1940 | United Kingdom | 366/12 |

*Primary Examiner*—Harvey C. Hornsby
*Assistant Examiner*—R. Alexander
*Attorney, Agent, or Firm*—Litman, McMahon & Brown

[57] ABSTRACT

A tumbler includes a support frame assembly rotatably mounting a drum assembly for driving by a drive assembly comprising an electric motor drivingly connected to the drum assembly, a battery coupled to the electric motor, and a photovoltaic panel connected to the battery for charging it.

2 Claims, 1 Drawing Sheet

TUMBLER

BACKGROUND OF THE INVENTION

1. Field of the Invention

The present invention relates generally to tumblers, and in particular to a compost tumbler driven by an electric motor powered by a battery which is charged by a photovoltaic panel.

2. Description of the Related Art

Tumblers have heretofore been utilized for processing a variety of different materials. Tumblers can be either powered by motors or turned by hand. Many include drums for receiving the materials being processed. The drum configurations and sizes can vary according to the particular processing requirements.

Tumblers have heretofore been used for mixing compost. Various types of biodegradable matter, such as grass clippings, leaves, manure, etc., are often mixed to form compost. Compost can be formed without tumbling equipment by creating "compost piles" wherein the compost ingredients are allowed to degrade naturally. However, heaping the materials on a pile and relying totally on static interaction can be relatively ineffective and can yield non-uniform results. Therefore, the compost matter has been actively mixed in tumblers to achieve uniformity in the compost and to facilitate the decomposition and biodegradation processes.

SUMMARY OF THE INVENTION

In the practice of the present invention, a tumbler is provided which includes a support frame assembly, a drum assembly rotatably mounted on the support frame assembly for rotation about a generally horizontal rotational axis, and a drive assembly including an electric motor drivingly connected to the drum assembly. The drive assembly also includes a battery selectively connected to the motor, a photovoltaic cell connected to the battery for charging same and a timer switch for selectively actuating the motor. The drum assembly includes a drum body with a generally rectangular cross-sectional configuration, a drum body interior and a door subassembly for providing access to the drum body interior. A hollow, tubular axle has opposite ends mounted on the support frame assembly and extends through the body interior. A water source is connected to the hollow, tubular axle for introducing water through perforations in the axle into the body interior.

OBJECTS AND ADVANTAGES OF THE INVENTION

The principle objects and advantages of the present invention include: providing a tumbler; providing a tumbler for compost; providing such a tumbler which is powered by an electric motor; providing such a tumbler which includes a photovoltaic cell array for charging and recharging an electric battery which powers the motor; providing such a tumbler which includes a timer switch for predetermined, intermittent operation; providing such a tumbler which is capable of substantially unattended, automatic operation; providing such a tumbler which is capable of producing compost with relatively uniform composition; providing such a tumbler which is economical to manufacture, efficient in operation, capable of a long operating life and particularly well adapted for the proposed usage thereof; and providing such a tumbler which is capable of operation substantially entirely on solar energy.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

Figure 1:
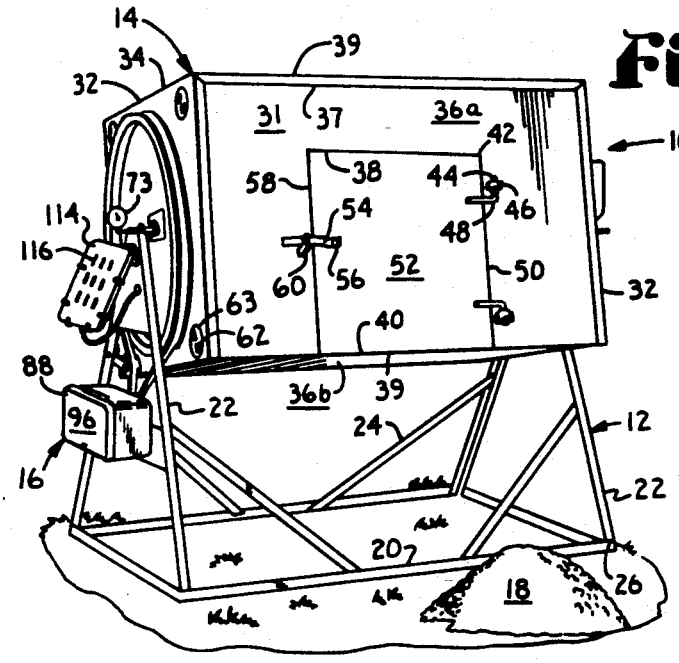
FIG. 1 is a front, left side perspective view of a tumbler embodying the present invention.
Figure 2:
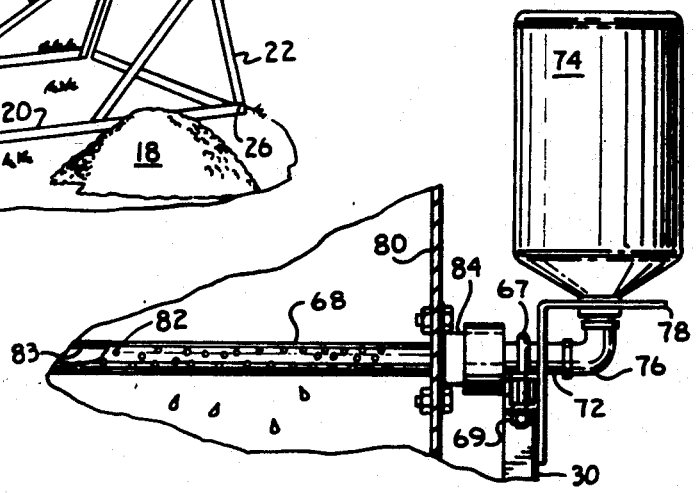
FIG. 2 is an enlarged, fragmentary front elevational view thereof.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

I. Introduction and Environment

Certain terminology will be used in the following description for convenience in reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, the reference numeral 10 generally designates a tumbler embodying the present invention. The tumbler generally includes a support frame assembly 12, a drum assembly 14 and a drive assembly 16. Without limitation on the generality of useful applications of the present invention, the tumbler 10 is particularly well adapted for tumbling compost 18, which can comprise grass cuttings, leaves, garbage and manure for biodegradation and use as fertilizer. Such compost 18 will generally be formed from organic, biodegradable matter, but other matter could be introduced.

II. Support Frame Assembly 12

The support frame assembly 12 includes a base 20, a pair of A-subframes 22 extending upwardly therefrom in generally parallel, spaced relation, and a plurality (e.g., four are shown) of diagonal braces 24. The A-subframes include lower ends 26 mounted on the base 20, upper ends 28 and gusset plates 30 in proximity to the upper ends 28.

The support frame assembly 12 can comprise various suitable structural members, such as angle iron and/or tubular sections of steel or other suitable materials.

III. Drum Assembly 14

Figure 5:
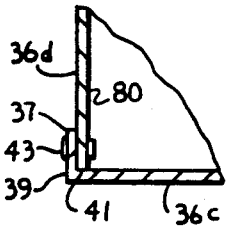
FIG. 5 is an enlarged, fragmentary, vertical, cross-sectional view thereof, particularly showing the intersection of two drum sidewalls thereof.
Figure 4:
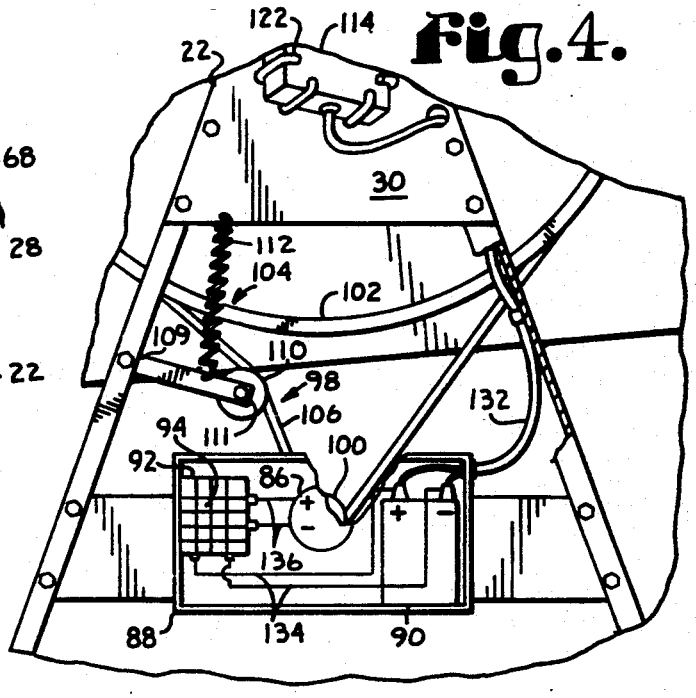
FIG. 4 is an enlarged, fragmentary left side elevational thereof.
Figure 3:
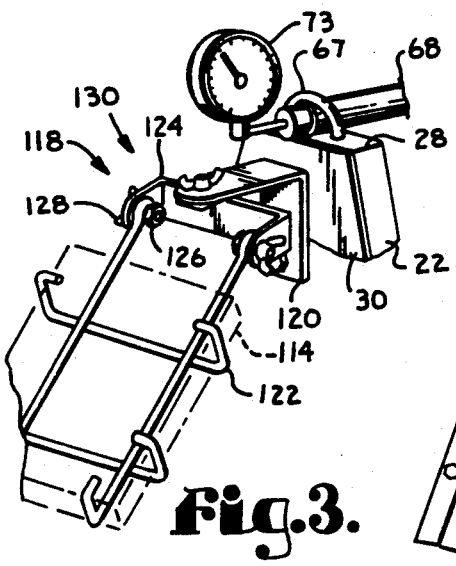
FIG. 3 is an enlarged, fragmentary, top, front, left side perspective view thereof, particularly showing a photovoltaic panel and mounting mechanism therefore.

The drum assembly 14 comprises a drum body 31 with opposite ends 32 having generally square end walls 34 mounted thereat. The drum body 31 includes sidewalls 36a, 36b, 36c and 36d extending between the end walls 34; the sidewall 36a having a body door opening 38 with a lower edge or threshold 40 which can be flush with an adjacent sidewall 36b. Each sidewall 36a–d includes a respective edge flange 37 extending along a respective flanged edge 39 thereof for connection to a respective straight longitudinal edge 41 of an adjacent sidewall 36a–d. The sidewalls 36a–d can be interconnected by rivets 43 as shown in FIG. 5.

A door subassembly 42 is mounted on the sidewall 36a by a hinge mechanism 44 including a pair of sleeves 46 mounted on the sidewall 36a adjacent to the opening 38 and a pair of L-shaped hinge pins 48 projecting from a proximate edge 50 of a door panel 52. The hinge pins 48 are rotatably journaled in the sleeves 46.

A latch mechanism 54 includes a latch arm 56 pivotally mounted on the door panel 52 adjacent to a distal edge 58 thereof and a latch keeper 60 mounted on the sidewall 36a for receiving and retaining the latch arm 56. The body end walls 34 include ventilation holes 62, which can be fitted with adjustable covers 63.

An axle subassembly 66 includes a hollow, tubular pipe which forms an axle 68 extending between and mounted on the A-subframes 22 by U-bolts 67 and nuts 69. The axle 68 is closed at a first end 70 by a rubber stopper 71 with a thermometer 73 extending therethrough and into an interior portion of the axle 68 for determining a temperature in a body interior 80. The axle 68 communicates with a water source comprising a container 74 by an elbow 76 at a second end 72 thereof. The container 74 is mounted on the gusset plate 30 by a container holder (e.g., a wire basket) 78. Alternatively, the water source could be a relatively continuous water source. The volume of water dispensed into the interior 80 of the body 31 can be controlled by appropriately sizing apertures 82 in the axle 68 communicating with an axle bore 83.

The axle subassembly 66 further includes a pair of bearings 84 each mounted on a respective end wall 34 with the axle 68 rotatably journaled therein. The axle 68 is fixed with the drum body 31 rotating therearound, but a rotating axle could also be provided.

IV. Drive Assembly 16

The drive assembly 16 includes an electric motor 86 (e.g., 12 volt D.C.) mounted in a cabinet 88 which also includes a battery (e.g., 12 volt) 90 and a timer 92 with front-mounted controls 94. The cabinet 88 includes a hinged door for selectively enclosing same.

A drive train subassembly 98 includes a relatively small sheave or pulley 100 mounted on the motor 86, a relatively large sheave or pulley 102 mounted on the drum body end wall 34, an idler pulley mechanism 104 mounted on a respective A-subframe 22 and a belt 106 reaved over the pulleys 100, 102 for drivingly interconnecting same. The large pulley 102 can be formed by bending a length of channel iron into the form of a circle and welding it on the drum body end wall 34 with a channel thereof open outwardly for receiving the belt 106.

The idler pulley mechanism 104 includes an arm 108 pivotally mounted at a proximal end 109 thereof on the A-subframe 22, an idler pulley 110 rotatably mounted on a distal end 111 of the arm 108, and a tension spring 112 interconnecting the arm 108 and the gusset plate 30 for biasing the idler pulley 110 against the belt 106 for tensioning same.

A photovoltaic panel 114 includes an array of photovoltaic cells 116 and is mounted on the gusset plate 30 by a mounting bracket subassembly 118. The mounting bracket subassembly 118 includes a support frame connector 120 attached to the gusset plate 30 and a photovoltaic panel connector 122, which can comprise a wire basket assembly which receives the photovoltaic panel 114. A connecting bracket 124 is rotatably mounted on the frame connector 120 and the panel connector 122 by suitable mechanical fasteners, such as bolts 126 and wing nuts 128, which provide for pivotal movement between the connectors 120, 122 about multiple rotational axes, whereby a universal joint connection system 130 is provided. The universal joint connection system 130 allows the panel 114 to be tilted and angled as appropriate to maximize its orientation toward the sun for correspondingly maximizing the electrical output thereof.

An electrical lead 132 extends from the panel 114 to the battery 90, and suitable electric leads 134, 136 interconnect the battery 90 and the timer switch 92, and the timer switch 92 and the electric motor 86 respectively.

V. Operation

In operation, suitable matter (e.g., grass cuttings, leaves, manure) can be placed in the drum body interior 80. The drum body 31 can be painted black to facilitate heating by the sun. The tumbler 10 is preferably placed in a sunny, outdoor location with the photovoltaic panel 114 oriented as much as possible towards the sun for maximum electrical output therefrom. The battery 90 will be charged and/or recharged by the photovoltaic panel 114, and will power the motor 86 when connected thereto by the timer switch 92. The duration and frequency of the motor operating cycles can be preset with the timer switch 92, and can depend upon the available energy in the battery 90, which in turn can depend upon the size of the photovoltaic panel 114 and the amount of solar energy received thereby and converted into electrical current. Other factors, such as the rotational speed of the drum body 31 and its size can influence the duration and frequency of the tumbler operation. However, the battery 90 can be sized to provide for daily operation of the tumbler 10 for relatively short intervals (e.g., a few minutes each), even though cloudy conditions may prevail with little or no electrical current input from the photovoltaic panel 114 on some days.

Tumbling the compost material tends to produce relatively uniform mixing and decomposition thereof. The flat sidewalls 36a–d of the drum body 31 further facilitate thorough tumbling since the compost mass tends to turn over on itself as the tumbler body 31 rotates. The vent holes 62 allow air circulation through the drum body interior 80 to facilitate an aerobic decomposition process. The sidewalls 36a–d can permit drainage of excess moisture from the body interior 80 at their respective interconnections (which can be unsealed to pass water) in proximity to the sidewall edge flanges 37.

Unloading the drum interior 80 is facilitated because the sidewall 36b is flush with the door opening threshold or lower edge 40 whereby the compost material can be scraped out, for example with a shovel, rake, hoe, etc.

It is to be understood that while certain forms of the present invention have been illustrated and described herein, it is not to be limited to the specific forms or arrangement of parts described and shown.

What is claimed and desired to be secured by Letters Patent is as follows:

1. A compost tumbler for connection to a water source, which includes:

(a) a support frame;

(b) a drum assembly including:

(1) a drum body with a generally rectangular cross-sectional configuration;

(2) said drum body having opposite, generally square end walls;

(3) said drum body having first, second, third and fourth generally rectangular sidewalls, said first sidewall having a door opening with a threshold adjacent to and substantially flush with said second sidewall;

(4) a door subassembly including a door panel with proximate and distal edges, a hinge mechanism hingedly mounting said door panel at its proximate edge to said first body sidewall adjacent to said door opening and a latch mechanism mounted on said door panel distal edge for selectively connecting said door panel adjacent to its distal edge to said first body sidewall;

(5) a pair of bearings each mounted on a respective end wall;

(6) a generally horizontal rotational axis coaxial with said bearings;

(7) a hollow, tubular axle with: a first, closed end; a second, open end; a bore extending between said ends; and a plurality of apertures communicating with said bore and with said body interior;

(8) a body interior enclosed by said sidewalls and said end walls;

(9) said pipe being journaled in said bearings in proximity to said pipe first and second ends respectively;

(10) said pipe first and second ends being mounted on said support frame; and

(11) water connection means for fluidically connecting said pipe bore to the water source; and (c) a drive assembly including:

(1) a large, body sheave comprising a channel member formed in a circular configuration and mounted on one of said body end walls coaxial with said body rotational axis;

(2) an electric motor mounted on said support frame;

(3) a motor sheave mounted on said motor and having a smaller diameter than a diameter of said body sheave;

(4) an endless belt reaved on said body and said motor sheaves;

(7) a battery electrically coupled to said motor;

(8) a photovoltaic panel including a photovoltaic cell electrically connected to said battery;

(9) a photovoltaic panel mounting bracket assembly including a support frame connector connected to said support frame, a photovoltaic panel connector connected to said photovoltaic panel, and a universal joint mechanism interconnecting said support frame connector and said panel connector for pivotal movement therebetween about multiple pivotal axes;

(10) a timer switch; and

(11) electrical wire connection means interconnecting said motor, said battery, said photovoltaic panel, and said timer switch.

2. A compost tumbler, which includes:

(a) a support frame assembly including:

(1) a base;

(2) a pair of A-subframes each having a lower end connected to said base and an upper end, said A-subframes being mounted on said base and extending upwardly therefrom in generally parallel, spaced relation;

(3) each said A-subframe including a gusset plate mounted on its upper end; and (4) four diagonal braces, two each connected to a respective A-subframe and to said base;

(b) a drum assembly including:

(1) a drum body with a generally rectangular cross-sectional configuration;

(2) said drum body having opposite, generally square end walls;

(3) said drum body having first, second, third and fourth generally rectangular sidewalls, said first sidewall having a door opening with a threshold adjacent to and substantially flush with said second sidewall;

(4) a door subassembly including a door panel with proximate and distal edges, a hinge mechanism hingedly mounting said door panel at its proximate edge to said first body sidewall adjacent to said door opening and a latch mechanism mounted on said door panel distal edge for selectively connecting said door panel adjacent to its distal edge to said first body sidewall;

(5) a plurality of vent holes in each said end wall;

(6) a pair of bearings each mounted on a respective end wall;

(7) a generally horizontal rotational axis coaxial with said bearings;

(8) a hollow, tubular axle comprising a pipe with: a first, closed end; a second, open end; a bore extending between said ends; and a plurality of apertures communicating with said bore and with said body interior;

(9) a body interior enclosed by said sidewalls and said end walls;

(10) said pipe being connected to said gusset plates in proximity to said pipe first and second ends respectively;

(11) said pipe being journaled in said bearings in proximity to said pipe first and second ends respectively;

(12) a water container mounted on said support frame assembly above a level of said drum assembly rotational axis in communication with said axle bore; and

(13) a thermometer communicating with said pipe bore through said closed end thereof; and (c) a drive assembly including:

(1) a large, body sheave comprising a channel member formed in a circular configuration and mounted on one of said body end walls coaxial with said body rotational axis;

(2) a cabinet mounted on one of said A-subframes and including a door movable between open and closed positions;

(3) an electric motor mounted in said cabinet;

(4) a motor sheave mounted on said motor and having a smaller diameter than a diameter of said body sheave;

(5) an endless belt reaved on said body and said motor sheaves;

(6) an idler pulley mechanism including an idler pulley arm with a proximal end pivotally mounted on one of said A-subframes and a distal end, an idler pulley rotatably mounted on said idler arm distal arm and an idler spring connected to said idler arm between the ends thereof and to said gusset plate on said one A-subframe for biasing said idler pulley against said belt;

(7) a battery located in said compartment;

(8) a photovoltaic panel including a plurality of photovoltaic cells electrically connected to said battery;

(9) a photovoltaic panel mounting bracket assembly including a frame connector connected to one of said A-subframe gusset plates, a photovoltaic panel connector connected to said photovoltaic panel, and a universal joint mechanism interconnecting said frame connector and said panel connector for pivotal movement therebetween about multiple pivotal axes;

(10) a timer switch positioned in said cabinet; and

(11) electrical wire connection means interconnecting said motor, said battery, said photovoltaic panel, and said timer switch.

* * * * *